United States Patent [19]

Taguchi

[11] Patent Number: 4,975,955

[45] Date of Patent: Dec. 4, 1990

[54] PATTERN MATCHING VOCODER USING LSP PARAMETERS

[75] Inventor: Tetsu Taguchi, Tokyo, Japan

[73] Assignee: NEC Corporation, Tokyo, Japan

[21] Appl. No.: 421,313

[22] Filed: Oct. 13, 1989

Related U.S. Application Data

[63] Continuation of Ser. No. 733,888, May 14, 1985, abandoned.

[30] Foreign Application Priority Data

May 14, 1984 [JP] Japan ..... 59-96036

[51] Int. Cl.[5] ..... G10L 7/02

[52] U.S. Cl. ..... 381/36

[58] Field of Search ..... 381/29-50, 381/51-53; 364/513.5

[56] References Cited

U.S. PATENT DOCUMENTS

| | | | |
|---|---|---|---|
| 3,624,302 | 11/1971 | Atal | 381/40 |
| 4,220,819 | 9/1980 | Atal | 381/40 |
| 4,270,027 | 5/1981 | Agrawal et al. | 381/31 |
| 4,301,329 | 11/1981 | Taguchi | 381/37 |
| 4,472,832 | 9/1984 | Atal et al. | 381/40 |
| 4,661,915 | 4/1987 | Ott | 364/513.5 |
| 4,701,954 | 10/1987 | Atal | 381/49 |
| 4,701,955 | 10/1987 | Taguchi | 381/51 |
| 4,707,858 | 11/1987 | Fette | 381/43 |
| 4,716,592 | 12/1987 | Ozawa et al. | 381/40 |

OTHER PUBLICATIONS

Itakura et al., "A Hardware Implementation of a New Narrow to Medium Band Speech Coding", IEEE ICASSP-82, pp. 1964-1967.

Reddy et al., "Use of Segmentation and Labeling in Analysis—Synthesis of Speech", IEEE ICASSP-77, May 9-11 1977, pp. 28-32.

UN et al., "A 4800 BPS LPC Vocoder with Improved Excitation", IEEE ICASSP-80, Apr. 9-11 1980, pp. 142-145.

B. S. Atal et al., "A New Model of LPC Excitation for Producing Natural-Sounding Speech at Low Bit Rates", Proc. ICASSP 82, pp. 614-617 (1982).

*Primary Examiner*—Gary V. Harkcom

*Assistant Examiner*—John A. Merecki

*Attorney, Agent, or Firm*—Foley & Lardner, Schwartz, Jeffery, Schwaab, Mack, Blumenthal & Evans

[57] ABSTRACT

The system utilizes a linear predictive coding (LPC) analyzer, an Attenuator, a line spectrum pair (LSP) analyzer, a reference pattern memory and a pattern matching device. The LPC analyzer derives LPC parameters from an input speech signal. The LPC parameters are attenuated in the attenuator and fed to the LSP analyzer for deriving LSP parameters which are in turn fed to the pattern matching device. The reference pattern memory stores a plurality of reference patterns composed of a sequence of LSP parameters for a variety of predetermined speech samples. The pattern matching device is connected to the LSP analyzer and the reference pattern memory to select the reference pattern which most closely resembles the input pattern from the LSP analyzer and to provide a label code as an output thereof. On the decoding side, a decoder is responsive to the label for generating LPC parameters corresponding to the reference pattern of the label. A residual signal which is also transmitted with the reference label is received and fed with the generated LPC parameters to a synthesis filter for providing a synthesized speech signal which is subsequently converted into an analog signal.

11 Claims, 6 Drawing Sheets

PATTERN MATCHING VOCODER USING LSP PARAMETERS

This application is a continuation of application Ser. No. 06/733,888, filed May 14, 1985, now abandoned.

BACKGROUND OF THE INVENTION:

The present invention relates to a speech signal coding and/or decoding system and, more particularly, to a speech signal coding and/or decoding system using a pattern matching based on LSP (i.e., Line Spectrum Pair) parameters.

In the coded transmission of speech signals, reducing the transmission data bit rate is an important factor in making effective use of transmission lines. A system, in which speech signals are transmitted while being separated into segments of spectral and excitation source information so that the original speech is reproducible on the basis of those segments of information, is frequently used to lower the bit rate of transmission. In a vocoder, for example, LPC, LSP and PARCOR coefficients are adopted as the spectral information of the speech signals whereas voiced/unvoiced discrimination, pitch and residual information are adopted as excitation source information. According to the vocoder, the transmission bit rate of the speech signal can go as low as 4.8 kb/sec, but the reproduced sound quality is not always satisfactory. Essentially, this is because the vocoder does not code the input speech waveform. In order to improve the reproduced speech quality, there has been proposed a multi-pulse type speech signal coding technique which codes and transmits the position and amplitude of a plurality of pulses as speech waveform information. The multi-pulse type speech signal coding technique is disclosed, for example, in B. S. Atal et al., "A New Model of LPC Excitation for Producing Natural Sounding Speech at Low Bit Rates", Proc. ICASSP 82, pp. 614–617 (1982) or in United States Patent Application Ser. No. 565,804, filed Dec. 27, 1983, by Kazunori Ozawa et al. for assignment to the present assignee.

According to the coding technique described above, although the reproduced speech quality is improved, the bit rates required for coding the multi-pulses usually are as high as 9.6 Kb/sec.

The pattern matching method has been proposed so as to make possible a drastic reduction in the data bit rates and to improve the reproduced speech quality. In this pattern matching method, each of multiple kinds of reference spectral envelope information (i.e. the reference pattern) prepared in advance is labeled, and pattern matching between spectral information (i.e., the input pattern) obtained by analyzing an input speech signal and the reference pattern is conducted to develop the distance between the two so that the label of the reference pattern, which is closest to (or at the minimum distance from) the input pattern, is coded and transmitted.

If the pattern matching system described above is used, the number of bits required for transmitting spectral information can be drastically reduced. Despite this fact, however, the pattern matching system has the following problems.

In this pattern matching system, more specifically, the principal parameters to be used as spectral information are the LSP parameters having relatively little pattern matching distortion, and the distance between the LSP parameter pattern of the input speech (i.e., the input pattern) and the reference pattern is computed according to an approximate equation using spectral sensitivity (which is defined as the distortion of the spectral envelope when minute changes are independently given to the respective elements of the LSP parameters) of the LSP parameters. It has been experimentally confirmed that the smaller the frequency interval $\Delta\omega$ between the respective elements of the LSP parameters becomes, the more inaccurate the spectral sensitivity value becomes. In other words, for the smaller interval $\Delta\omega$, the minute changes in the respective elements of the LSP parameters greatly influence the overall spectrum envelope properties, thereby making it difficult to match patterns precisely. Accordingly, this problem is quite evident because the LSP frequency interval $\Delta\omega$ obtained by the LSP analysis has a higher occurrence rate for a smaller value than for a larger value.

SUMMARY OF THE INVENTION:

It is, therefore, an object of the present invention to provide a speech signal coding and/or decoding system which makes a low bit rate transmission possible.

Another object of the present invention is to provide a speech signal coding and/or decoding system which improves reproduced speech quality and makes low bit rate transmission possible.

Still another object of the present invention is to provide a speech signal coding and/or decoding system which further improves reproduced speech quality.

A further object of the present invention is to provide a speech signal coding and/or decoding system which is based upon pattern matching with LSP parameters.

According to the present invention, there is provided a speech signal coding and/or decoding system comprising: LPC analysis means for deriving linear predictive coefficients (i.e., LPC parameters) from an input speech signal; attenuating means for attenuating said LPC parameters by predetermined attenuation coefficients; LSP analysis means for deriving Line Spectrum Pairs (i.e., LSP) parameters from the attenuated LPC parameter. from said attenuating means and generating a sequence of said LSP parameters as an input pattern; a reference pattern memory for storing reference patterns each composed of a sequence of the LSP parameters obtained by LSP-analyzing a variety of predetermined speech samples, each of said reference pattern being labeled by a predetermined label; and means for selecting the reference pattern most closely resembling said input pattern from said reference pattern memory and coding said label of the reference pattern selected.

Other objects and features of the present invention will become apparent by reference to the following description taken in conjunction with the accompanying drawings.

Figure 1A:
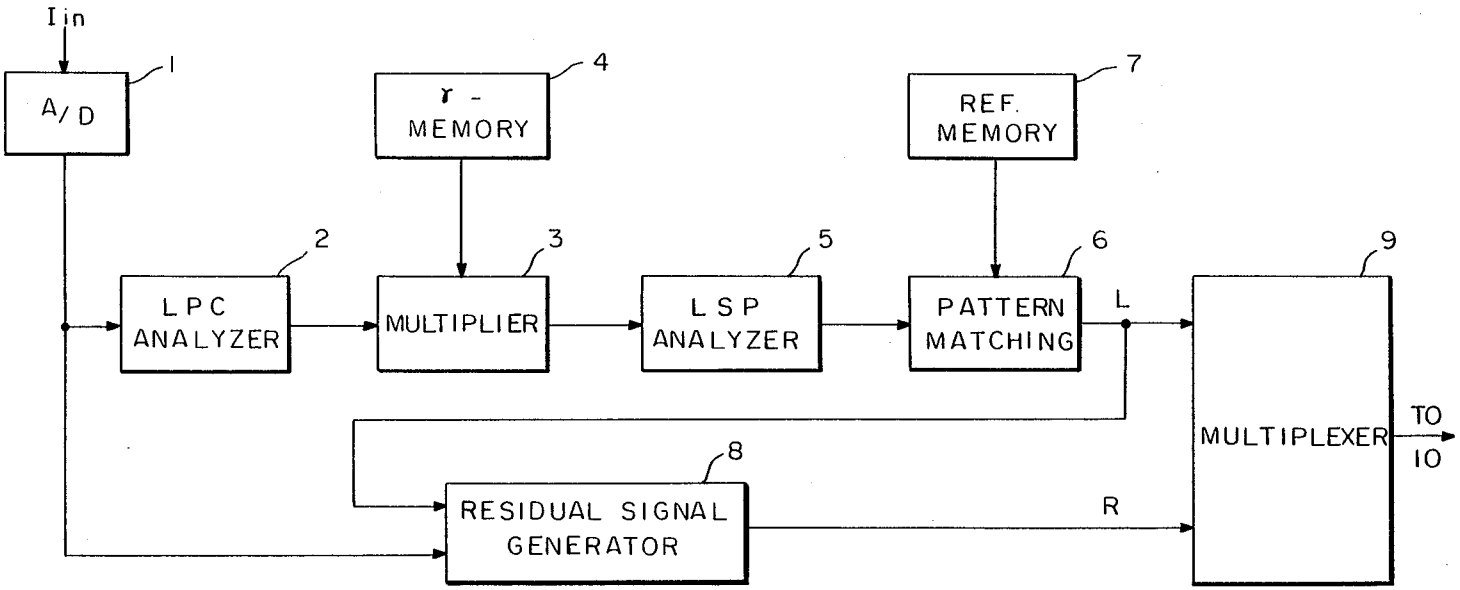
FIGS. 1A and 1B are block diagrams showing the fundamental structures of the present inventions, for analysis (transmission) and synthesis (reception) sides.

DESCRIPTION OF THE PREFERRED EMBODIMENTS:

With reference to FIG. 1A, an input speech signal $I_{in}$ is first subjected to low-pass filtering by an A/D converter 1 having a built-in low pass filter (i.e., LPF) and is then digitized at a predetermined sampling frequency, 8 KHz. The low-pass filtering blocks out the band above 3.2 KHz in the present embodiment. The output of the A/D converter 1 is sampled at 8 KHz, quantized into a predetermined number of bits and fed to an LPC analyzer 2.

The LPC analyzer 2 temporarily stores the quantized data thus fed in a buffer, then reads out the stored data to multiply it by a predetermined window function thereby to smooth out extremely sharp spectral peaks. Then, the LPC analyzer 2 conducts linear predictive analysis to derive n-th order linear predictive coefficients, e.g., tenth-order $\alpha$ parameters ($\alpha_1$ to $\alpha_{10}$) in the present embodiment for each frame. The linear predictive analysis thus conducted determines a spectral distribution envelope. The $\alpha$ parameters are multiplied in an attenuation coefficient multiplier 3 by an attenuation coefficient$\gamma$ read out from an attenuation coefficient table memory 4 and the multiplied parameters are supplied to an LSP analyzer 5.

By making use of attenuated $\alpha$ parameters thus input, the LSP analyzer 5 analyzes and extracts the tenth-order LSPs and supplies them as an input pattern to a pattern matching unit 6. The pattern matching unit 6 matches the input pattern with reference patterns from a reference pattern memory 7 to select a reference pattern having the minimum spectral distance. In this case, the $\alpha$ parameters are multiplied by the attenuation coefficient so that excessive spectral sensitivity due to the narrow frequency interval of the LSP is suppressed. The LSP analysis and the pattern matching will be described in detail in the following.

The LSP analyzer 5 determines the LSP coefficients by making use of the LPC coefficients supplied thereto after having been multiplied by the attenuation coefficients. The LSP coefficients are frequently used as parameters indicating the resonance characteristics of a vocal tract, and are well known as the parameters coming from the line spectrum pairs of the vocal tract transmission functions if the vocal tract is imagined to be completely opened or shut.

The LSP analyzer 5 develops tenth order LSP coefficients from the linear predictive coefficient ($\alpha$ parameters), which are input from the attenuation coefficient multiplier 3 after having been attenuated, by the well-known Newton-Raphson method or the zero-point searching method. The LSP coefficients thus obtained are line spectrum vectors $\omega_1, \omega_2, \ldots,$ and $\omega_{10}$ for expressing the transmission functions of the vocal tract filter in terms of frequency regions, as has been described hereinbefore. According to the attenuation coefficient multiplications of the LPC coefficients, which are executed prior to the LSP development, the minimum frequency interval $\Delta\omega_{MIN}$ of the LSP coefficients are enlarged, as will be described later, to facilitate pattern matching and to enhance the operating stability of a vocally synthesizing all pole type digital filter at the synthesis side.

The aforementioned reference patterns are the distribution patterns of the reference LSP coefficients which are obtained by LSP-analyzing vocal materials prepared in advance. In the present embodiment $2^{12}$ different kinds are prepared. The spectral distance is fundamentally expressed by $D_{ij}$ of the following Equation (1):

$$D_{ij} = 1/\pi \int_0^{\pi} \{S_i(\omega) - S_j(\omega)\}^2 d\omega \tag{1}$$

In Equation (1), $S_i(\omega)$ and $S_j(\omega)$ are logarithmic spectra of the input pattern and reference pattern, respectively. Equation (1) is usually transformed and used in the form of the following approximate Equation (2):

$$D_{ij} \approx \sum_{K=1}^{N} W_K \{P_K^{(i)} - P_K^{(j)}\}^2 \tag{2}$$

In Equation (2), $P_K^{(i)}$ and $P_K^{(j)}$ designate the N-th order LSP coefficients of the input pattern and reference pattern, respectively, $W_K$ designates the N-th order LSP spectral sensitivity. N designates the order of the all pole type LPC digital filter, i.e., 10 in the present embodiment. $P_1, P_2, \ldots, P_{10}$ correspond to the LSP frequency pairs $\omega_1, \omega_2 \ldots,$ and $\omega_{10}$. Moreover, the N-th order spectral sensitivity $W_K$ indicates the extent of the spectral changes which are caused by minute changes of the LSP coefficients of the N-th order, i.e., tenth-order in the present embodiment, as has been described hereinbefore.

The LSP reference pattern number (or label) L, which is selected through the pattern matching is fed to a multiplexer 9. By thus adopting the pattern matching method, as the spectral data for each analysis frame, the labels are developed, coded and transmitted so that the transmission bit rate can be drastically reduced.

Here, the meaning of multiplying the LPC parameters (or the $\alpha$ parameters) by attenuation coefficient $\gamma$ will be described in detail in the following.

Figure 2:
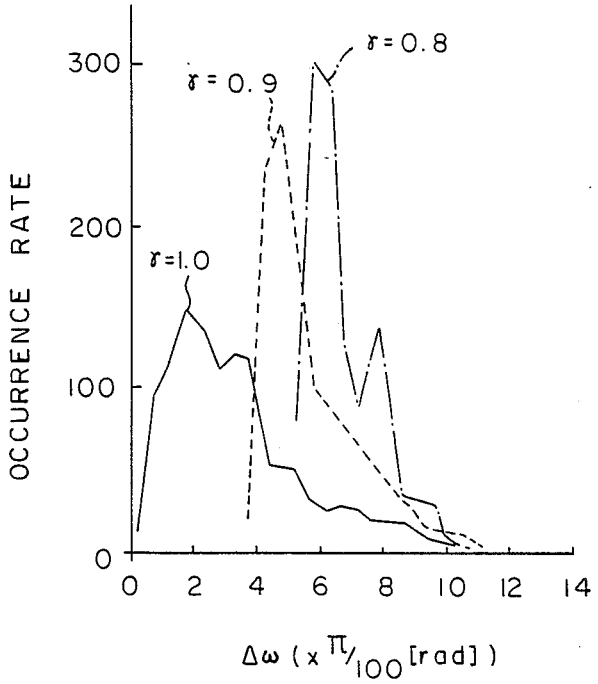
FIG. 2 is a statistical graph showing the occurrence rate distribution of the frequency interval $\Delta\omega$ of the LSP parameters for various attenuation parameters ($\gamma$32 1.0, 0.9, 0.8)
Figure 3:
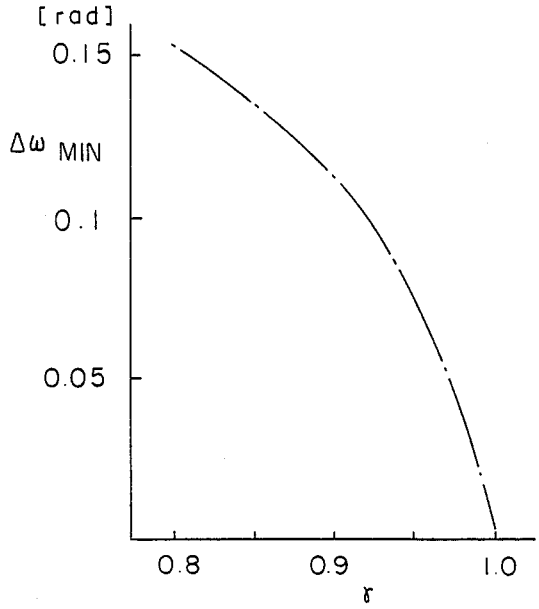
FIG. 3 is a graph showing the relationship between the attenuation coefficient ; and the minimum frequency interval $\Delta\omega_{MIN}$.
Figure 4:
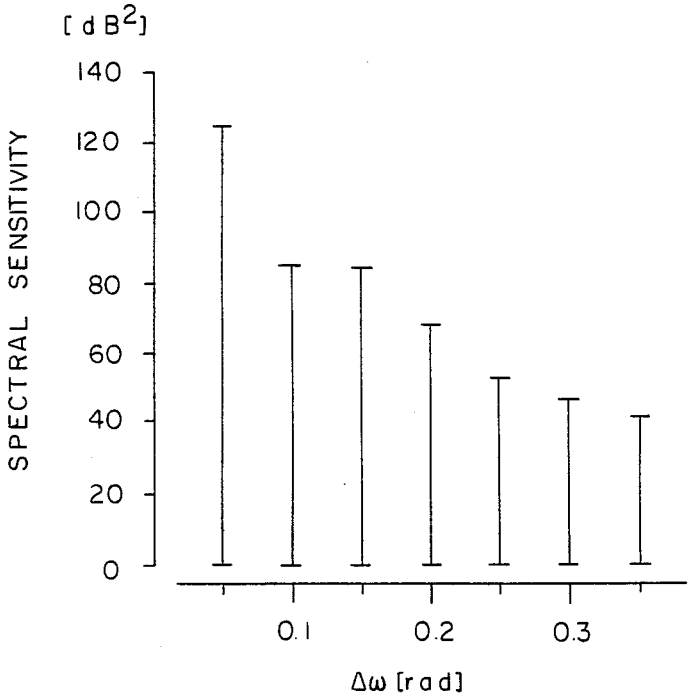
FIG. 4 is a graph showing the relationships between the frequency intervals $\Delta\omega$ and pattern matching distortions.

FIG. 2 shows the statistical occurrence rate distribution of the LSP frequency interval $\Delta\omega$. As is apparent from FIG. 2, the occurrence rate is high in the small value region of $\Delta\omega$, i.e., in the range $\pi/100$ to $4\pi/100$ rad when the $\alpha$ parameters are not attenuated (i.e., $\gamma=1.0$). FIG. 3 shows the relationship between the attenuation coefficient $\gamma$ and the minimum frequency interval $\Delta\omega_{MIN}$ of the LSP parameters and suggests that 25 the minimum frequency interval $\Delta\omega_{MIN}$ be smaller for the larger $\gamma$. FIG. 4 shows the relationships between the intervals of the LSP parameters $\omega_1$ and $\omega_2$ obtained by the tenth order LSP analysis and distribution ranges of the pattern matching distortion. Here, the pattern matching distortion indicates the cumulative distance of the respective LSP parameters between the reference pattern selected by pattern matching and the input pattern.

It is apparent from FIG. 4 that pattern matching distortion is greater for the smaller LSP frequency interval. If, therefore, the LSP parameters are derived directly from the $\alpha$ parameters or the LPC coefficients, as shown in FIGS. 2 and 3, the LSP frequency interval $\Delta\omega$ has a tendency to take a small value and the pattern matching distortion is enlarged, thereby degrading pattern matching precision and reproduced speech quality.

On the other hand, if the LSP parameters are derived after the parameters are attenuated by the attenuation coefficient $\gamma=0.9$ or $\gamma=0.8$, the LSP frequency interval $\Delta\omega$ is shifted to a larger value. This is easily understandable from the relationship between the attenuation coefficient $\gamma$ and the minimum frequency interval $\Delta\omega_{MIN}$ shown in FIG. 3. Multiplying the $\alpha$ parameters by the attenuation coefficients enlarges the LSP frequency interval $\Delta\omega$ so that pattern matching distortion is reduced, thereby improving pattern matching precision and reproduced speech quality.

Returning to FIG. 1A, the speech signal spectral information is coded and transformed, as described hereinbefore, whereas the residual information R is attained and coded in a residual signal generator 8 on the basis of the speech signal from the A/D converter 1.

Figure 1B:
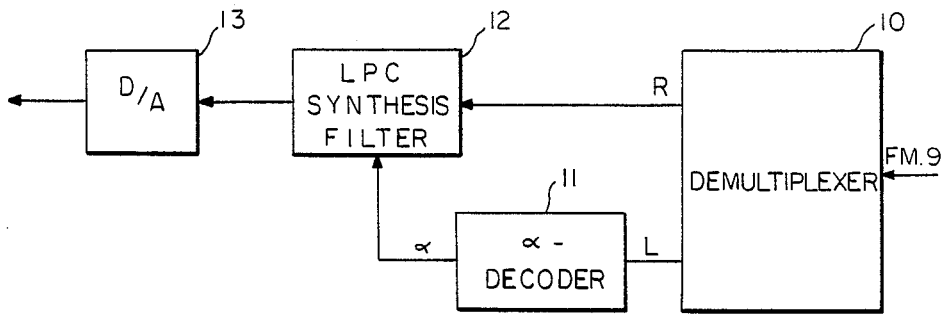

At the synthesis (reception) side as shown in FIG. 1B, the spectral information (the label of the reference pattern) and the residual information of the speech signal thus superimposed and transmitted, are separated by a demultiplexer 10, and the residual information R is fed as an excitation signal to an LPC synthesis filter 12. The label L of the reference pattern indicating spectral information is fed to an $\alpha$ parameter decoder 11.

The $\alpha$ parameter decoder 11 decodes the $\alpha$ parameters $\alpha_1$ to $\alpha_{10}$ from the reference pattern label (number) L for each analysis frame by operations inverted from the analysis shown in FIG. 1A and sends them to the LPC synthesis filter 12.

The LPC synthesis filter 12 is a digital filter which is excited by the residual signal and controlled by the $\alpha$ parameters thus supplied and which reproduces the quantized input speech signal and sends it to a D/A converter 13.

The D/A converter 13 converts the quantized input speech signal into the original input speech signal through an LPF (Low Pass Filter) or the like.

Figure 5:
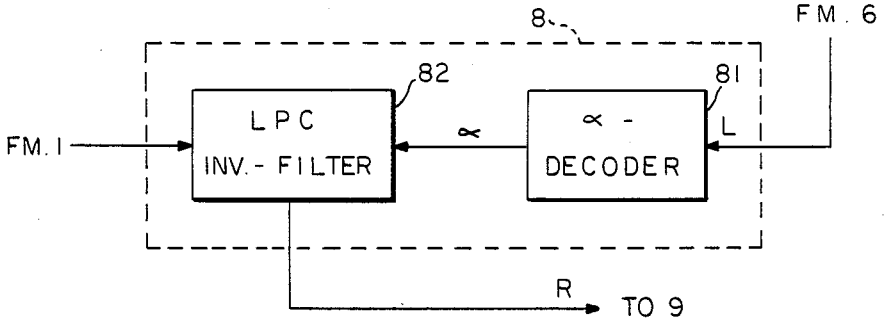
FIG. 5 is a block diagram showing an example of a residual signal generator of FIg. 1A, which is based on an LPC inverse filter.

Next, the residual signal generator at the analysis side will be described in the following. FIG. 5 shows an example of the residual signal generator using an LPC inverse-filter. An $\alpha$ parameter decoder 81 is equipped with a reference pattern table similar to the reference pattern memory 7 and reads out the parameters $\alpha_1$ to $\alpha_{10}$ corresponding to the reference pattern label (number) L in response to said label L. The LPC inverse filter 82 has frequency responding characteristics inverted from those of the LPC synthesis filter 12 shown in FIG. 1B. In response to the input speech signal from the A/D converter 1 and the $\alpha$ parameters $\alpha_1$ to $\alpha_{10}$, the LPC inverse-filter 82 generates the residual information R, which is obtained by removing the spectral data from the input speech signal, codes and supplies it to the multiplexer 9.

Figure 6A:
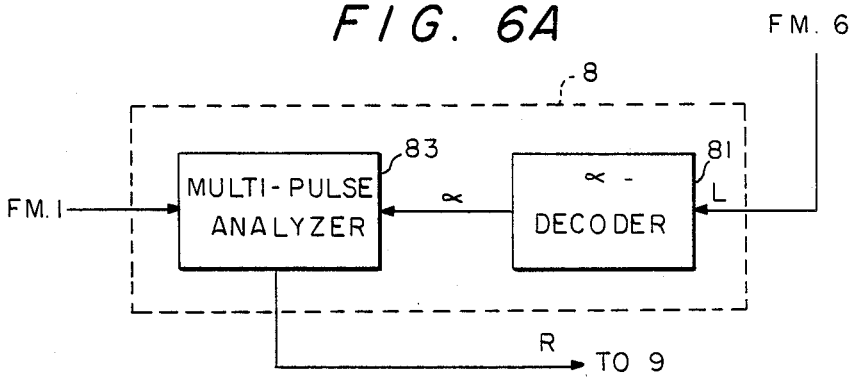
FIGS. 6A and 6B are block diagrams of other examples of the residual signal generator in the analysis side and of a construction in the synthesis side which are based upon multi-pulse analysis and synthesis.

FIG. 6A shows another example of the residual signal generator, aiming at remarkable improvement in reproduced speech quality and reduction of the data bit rate by using the aforementioned multi-pulses as residual information. Multi-pulse analysis is one method of residual signal coding in which a sequence for the excitation source signal is generated. Multi-pulse analysis expresses the residual signal as a sequence of plural impulses, i.e., the so-called "multi-pulses".

In response to both the quantized input speech signals outputted from the D/A converter 1 and the $\alpha$ parameters generated on the basis of the label signal L supplied from the $\alpha$ parameter decoder 81, a multi-pulse analyzer 83 executes multi-pulse analysis for each analysis frame to determine the sequence of the optimal multi-pulses and codes and feeds it to the multiplexer 9.

Figure 6B:
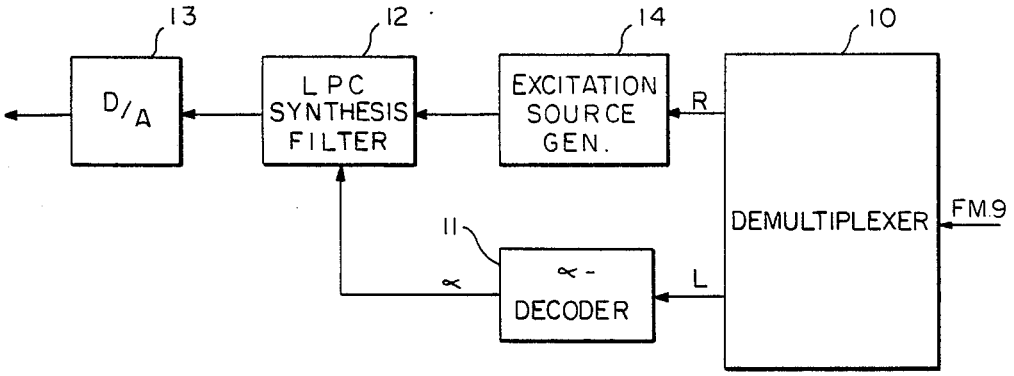

For synthesis, as shown in FIG. 6B, the multi-pulse information as the residual signal R, which is separated by the demultiplexer 10, is supplied to an excitation source generator 14. The excitation source generator 14 reproduces the multi-pulses as the excitation pulse sequence for each analysis frame and the reproduced multi-pulses are sent out to the synthesis filter 12.

Figure 7A:
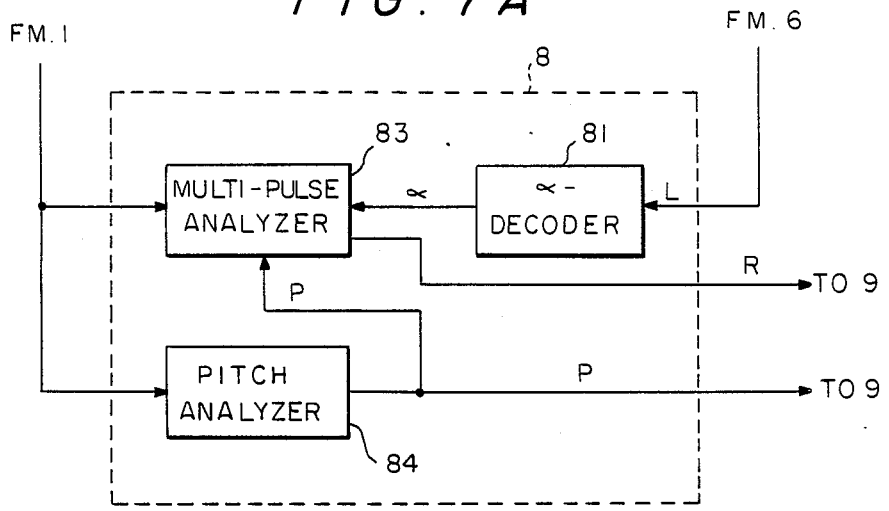
FIGS. 7A and 7B are block diagrams showing improved examples of the residual signal generators in the analysis and synthesis sides shown in FIGS. 6A and 6B, respectively.

FIG. 7A shows an example in which a pitch predicting means is added so as to improve the efficiency of the multi-pulse analysis and coding of FIG. 6A.

In response to the quantized input speech signals from the A/D converter 1, a pitch analyzer 84 executes pitch analysis through an autocorrelation or the like to extract analysis information such as pitch period and pitch gain which is a predicted pitch prior to each analysis frame and to send out that analysis information as a pitch predictive coefficient P to the multi-pulse analyzer 83 and the multiplexer 9. The multi-pulse analyzer 83 has a built-in pitch predictor to execute pitch prediction and outputs the multi-pulse information as the residual signal R concerning the pulse position, normalized amplitude, maximum amplitude and the number of pulses. The pitch prediction makes it possible to reduce the information to be transmitted.

The reason why the pitch period can also be analyzed through such predictive information is that pitch periods as short as 10 milliseconds are as a rule, not abruptly changed and frequently remain substantially uniform over a plurality of analysis frames.

Figure 7B:
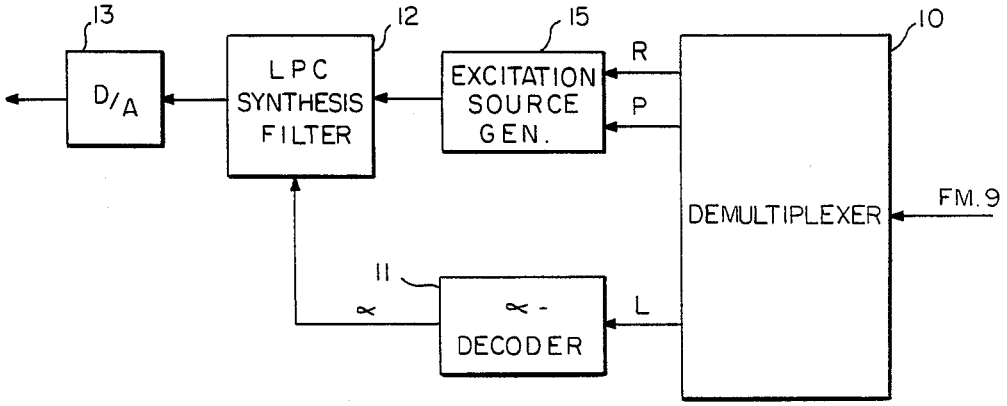

On the synthesis side shown in FIG. 7B, both the pitch predictive coefficient P and the residual signal R concerning the signal waveform information are separated by the demultiplexer 10 and are fed to an excitation source generator 15. The excitation source generator 15 is equipped with a pitch predictor and reproduces the multi-pulse sequence including the eliminated pulses at the analysis side by making use of those input data signals and supplies the reproduced multi-pulse sequence to the LPC synthesis filter 12. The remaining structure is the same as that of FIG. 1B.

Figure 8A:
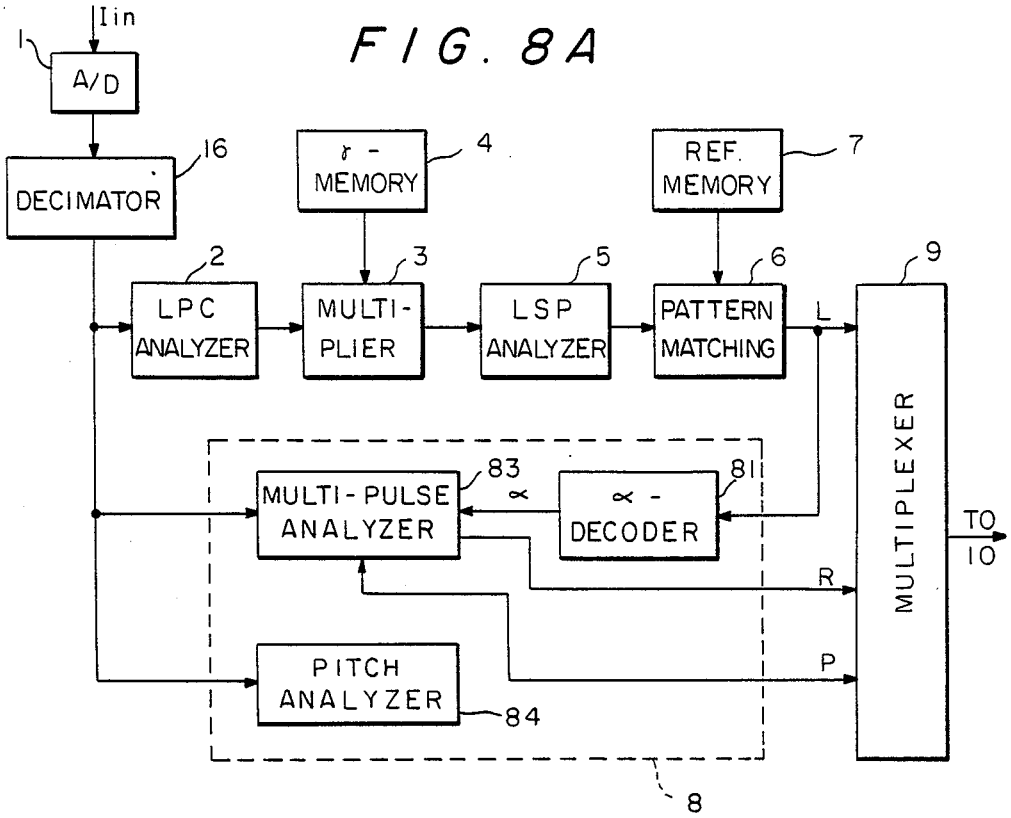
FIGS. 8A and 8B are block diagrams showing improved examples of the residual signal generators shown in FIGS. 6A, 7A and 6B, 7B on the basis of multi-pulse analysis in which decimation sampling has been adopted, respectively.

FIG. 8A shows an example improved over that of FIG. 7A, i.e., an example in which the transmission bit rate can be reduced more markedly.

A decimator 16 temporarily resamples the quantized data of the input speech signals, which have been sampled at a frequency of 8 KHz by the A/D converter 1, at a frequency of 24 KHz, then extracts samples for each one quarter to execute the "decimate sampling". According to this decimate sampling the necessary data bit rate is reduced due to converting the sampling frequency from 8 KHz into 6 KHz. Here, the degradation of the transmission characteristics by the decimation should be taken into consideration. In either the transmission of the usual speech signal or the vocoder, the speech signals are subjected to low-pass filtering by the LPF having a high-band (critical) frequency of about 3.2 to 3.4 KHz. It has been verified that this is sufficient to preserve the quality of the original speech signal. In the present embodiment, the degradation of the speech quality due to the decimate sampling of 6 KHz raises no substantial problem, while considering the critical frequency 3.2 KHz of the LPF and the data which can be eliminated under the influence of the attenuation characteristics of the LPF in the vicinity of the critical frequency, so that the transmission data bit rate can be markedly improved.

This is substantially unchanged in principle even if the critical frequency of the LPF is 3.4 KHz. The aforementioned upsampling frequency of 24 KHz is introduced as the least common multiple of the sampling frequency of 8 KHz at the A/D converter 1 and the sampling frequency of 6 KHz to be decimated.

At the analysis side shown in FIG. 8A, analysis is executed substantially similarly to the case of FIG. 7A except for the sampling frequency decimation, and the data are sent out for synthesis through the multiplexer 9.

Figure 8B:
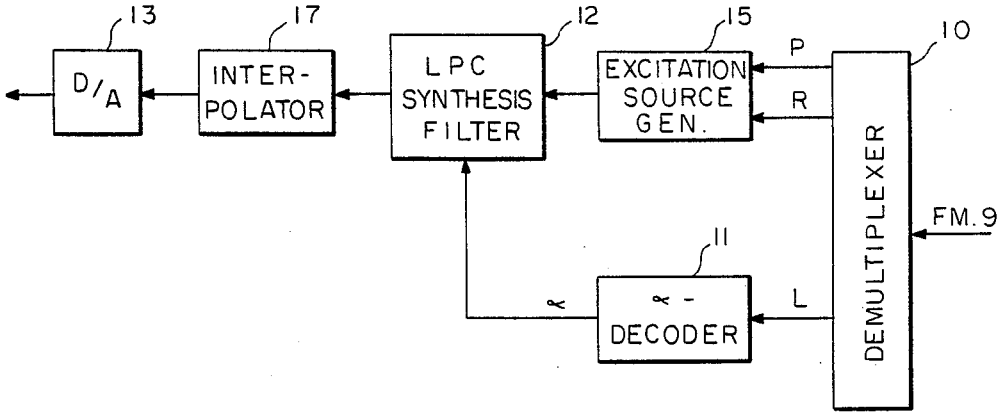

In synthesis in FIG. 8B, the quantized input speech signals with the decimate sampling frequency of 6 KHz are reproduced by operations substantially similar to those of the synthesis in FIG. 7B and are then fed to an interpolator 17.

The interpolator 17 interpolates the sampled data of 6 KHz to obtain the sampled value of 24 KHz and determines the sampled value of 8 KHz by such decimate sampling as to take one-third of the sampled value of 8 KHz.

Thus, it is possible to code and decode the speech signals with further lower bit rates of transmission than the embodiments shown in FIGS. 7A and 7B and to easily execute the signal waveform coding as the speech CODEC of 4.8 Kb/sec. It is apparent that the embodiments thus far described can be basically applied to the embodiment shown in FIGS. 1A and 1B.

What is claimed is:

1. A speech signal processing system comprising:

linear predictive coefficient (LPC) analysis means for deriving LPC parameters $\alpha_i$ (i=1,2, . . . n) from an input speech signal where i is the order of each LPC parameters;

attenuation coefficient producing means for producing attenuation coefficients determined by said orders of said LPC parameters;

attenuating means, coupled to said attenuation coefficient producing means and to said LPC analysis means, for attenuating said LPC parameters into attenuated LPC parameters by multiplying each LPC parameter by the attenuation coefficient corresponding to the order of the LPC parameter; line spectrum pair (LSP) analyzing means for deriving LSP parameters from said attenuated LPC parameters supplied from said attenuating means and for generating a sequence of said LSP parameters as an input pattern, said LSP parameters having frequency intervals dependent on said attenuation coefficients;

a reference pattern memory for storing reference patterns, each composed of a sequence of LSP parameters obtained by LSP-analyzing a variety of a plurality of speech samples, each of said reference patterns being labeled by a label; and pattern matching means, connected to said LSP analyzing means and to said reference pattern memory, for selecting a reference pattern, most closely resembling said input pattern, from said reference pattern memory and for coding said label corresponding to said selected reference pattern.

2. A speech signal processing system according to claim 1, further comprising residual signal generating means for generating and coding a residual signal of said input speech signal.

3. A speech signal processing system according to claim 2, further comprising:

decoding means responsive to said label for generating the LPC parameters corresponding to the reference pattern of said label;

a synthesis filter connected to said decoding means and said residual signal generating means for synthesizing the speech signal in response to outputs of said residual signal generating means and said decoding means; and a digital to analog (D/A) converter for converting the synthesized speech signal into an analog signal.

4. A speech signal processing system according to claim 2, wherein said residual signal generating means includes LPC decoding means responsive to said label for generating LPC parameters corresponding to the labeled reference pattern selected by said pattern matching means; and LPC inverse filter means responsive to said LPC parameters from said LPC decoding means and to said input speech signal for generating said residual signal.

5. A speech signal processing system according to claim 2, wherein said residual signal generating means includes first LPC decoding means, responsive to said label, for generating LPC parameters corresponding to the labeled reference pattern selected by said pattern matching means; and multi-pulse analyzing means, connected to said first LPC decoding means and connected to receive said input speech signals, for generating and coding a multi-phase signal of a plurality of pulses, each pulse having information of position and amplitude, in response to said input speech signals and the LPC parameters from said first LPC decoding means.

6. A speech signal processing system according to claim 5, further comprising second LPC decoding means responsive to said label for generating LPC parameters corresponding to the labeled reference pattern selected by said pattern matching means; excitation source generating means for decoding said coded multipulse signal to produce a decoded signal as an excitation source signal; a synthesis filter connected to said second LPC decoding means and said excitation source generating means for synthesizing a speech signal on the basis of the LPC parameters from said second LPC decoding means and the excitation source signal from said excitation source generating means, said synthesis filter providing a synthesized speech signal at an output thereof; and a digital to analog (D/A) converter connected to the output of said synthesis filter for converting the synthesized speech signal of said synthesis filter into an analog signal.

7. A speech signal processing system according to claim 2, wherein said residual signal generating means includes first LPC decoding means, responsive to said label, for generating LPC parameters corresponding to the labeled reference pattern selected by said pattern matching means; pitch analyzer means for analyzing the pitch period of said input speech signal to predict a future pitch period thereby to output a pitch predictive coefficient; and multi-pulse analysis means, connected to said first LPC decoding means and to said pitch analyzer means and responsive to said input speech signal, the LPC parameters from said LPC decoding means and said pitch predictive coefficient of said pitch analyzer means, for outputting a multi-pulse signal having position and amplitude information of a plurality of pulses from which unnecessary pulses have been eliminated by said pitch prediction.

8. A speech signal processing system according to claim 7, further comprising: second LPC decoding means responsive to said label for generating LPC parameters corresponding to the labeled reference pattern selected by said pattern matching means; excitation source generating means, responsive to said multi-phase signal and said pitch predictive coefficient, for outputting a plurality of pulse position and amplitude information pulses containing the pulses which are eliminated by said multi-pulse analysis means; a synthesis filter, connected to said excitation source generating means and said second LPC decoding means, for synthesizing said speech signal on the basis of the LPC parameters from said second decoding means and the output from said excitation source generating means, said synthesis filter providing a synthesized speech signal at an output thereof; and a digital to analog (D/A) converter connected to the output of said synthesis filter for converting the synthesized speech signal of said synthesis filter into an analog signal.

9. A speech signal processing system according to claim 1, further comprising:

an analog to digital (A/D) converter for converting said input speech signal into a digital signal; and first conversion means for converting said A/D converter output into a sampling signal having a sampling frequency lower than that of said A/D converter and for supplying said sampled signal to said LPC analyzer.

10. A speech processing system according to claim 9, further comprising means for generating and coding a residual signal of said input speech signal.

11. A speech signal processing system according to claim 10, further comprising:

decoding means, responsive to the coded label of the reference selected pattern for outputting the LPC parameters corresponding to the labeled reference pattern selected by said pattern matching means;

a synthesis filter for synthesizing said speech signal on the basis of said residual signal and the LPC parameters from said decoding means;

second conversion means for converting the output of said synthesis filter into a sampling signal having a sampling frequency the same as the sampling frequency of said A/D converter; and a digital to analog (D/A) converter for converting the output of said second conversion means into an analog signal.

* * * * *